US006913160B2

(12) United States Patent
Bourreau et al.

(10) Patent No.: US 6,913,160 B2
(45) Date of Patent: Jul. 5, 2005

(54) COMPOSITE CLOSURE CAP

(75) Inventors: Jean-Marie Bourreau, Le Pizou (FR); Jacques Granger, Sainte Terre (FR)

(73) Assignee: Pechiney Emballage Alimentaire, Clichy (FR)

( * ) Notice: Subject to any disclaimer, the term of this patent is extended or adjusted under 35 U.S.C. 154(b) by 164 days.

(21) Appl. No.: 10/149,404

(22) PCT Filed: Dec. 11, 2000

(86) PCT No.: PCT/FR00/03470

§ 371 (c)(1),
(2), (4) Date: Jul. 8, 2002

(87) PCT Pub. No.: WO01/44066

PCT Pub. Date: Jun. 21, 2001

(65) Prior Publication Data

US 2003/0042220 A1 Mar. 6, 2003

(30) Foreign Application Priority Data

Dec. 14, 1999 (FR) ..... 99 15750

(51) Int. Cl.[7] ..... B65D 53/00

(52) U.S. Cl. ..... 215/459.1; 222/551

(58) Field of Search ..... 215/230, 334; 206/459.1, 459.5; 264/268; 222/548, 549, 551

(56) References Cited

U.S. PATENT DOCUMENTS

| | | | | |
|---|---|---|---|---|
| 2,990,078 A | | 6/1961 | Fields | |
| 3,215,297 A | * | 11/1965 | Acton et al. | 215/334 |
| 3,532,243 A | * | 10/1970 | Acton | 215/334 |
| 3,631,650 A | * | 1/1972 | Leftault, Jr. | 215/334 |
| 5,176,269 A | * | 1/1993 | Herman | 215/334 |
| 6,403,173 B1 | * | 6/2002 | Granger et al. | 215/305 |

FOREIGN PATENT DOCUMENTS

| | | |
|---|---|---|
| FR | 1214383 | 4/1960 |
| FR | 1362085 | 9/1964 |
| FR | 2763046 | 11/1998 |
| WO | 98/52833 | 11/1998 |
| WO | 98/52838 | 11/1998 |
| WO | 99/06294 | 2/1999 |

* cited by examiner

*Primary Examiner*—Kenneth Bomberg
(74) *Attorney, Agent, or Firm*—Dennison, Schultz, Dougherty & MacDonald

(57) ABSTRACT

The invention concerns a cap (1) comprising as assembly consisting of: a) a plastic insert (2) comprising a head (3) with closure means (31, 32) and a threaded skirt (4), and b) a metal wall. The invention is characterised in that: 1) said metal wall (5) covers all or part of the outer surface of said insert (2) and includes at least a metal skirt (51) for receiving said skirt (4) of said insert (2); said metal skirt (51) includes an edge (510) crimped to said insert (2) so as to assemble together said metal wall (5) and said insert (2); 3) said cap comprises means designed to provide weight and/or volume to the part of said cap located above said sealing closure means (31, 32).

18 Claims, 6 Drawing Sheets

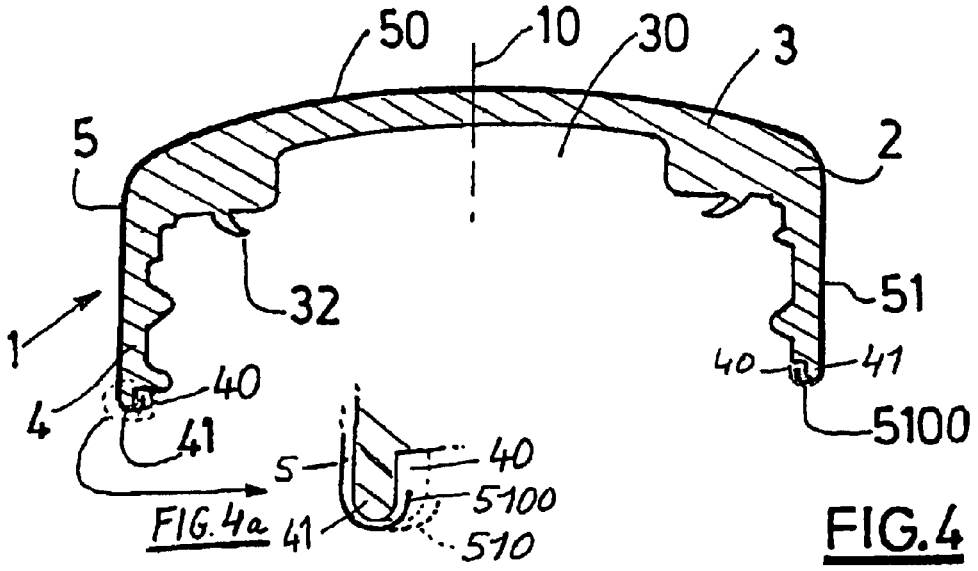
FIG.4a
FIG.4
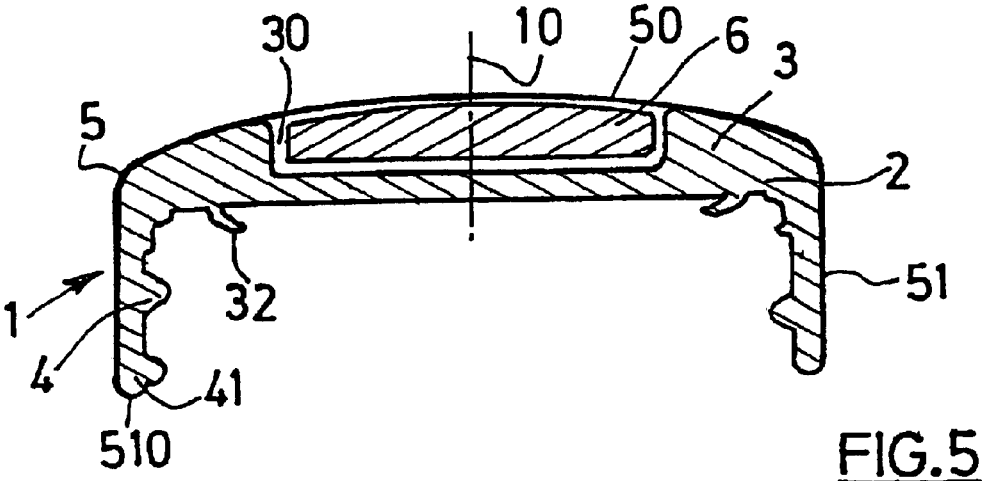
FIG.5
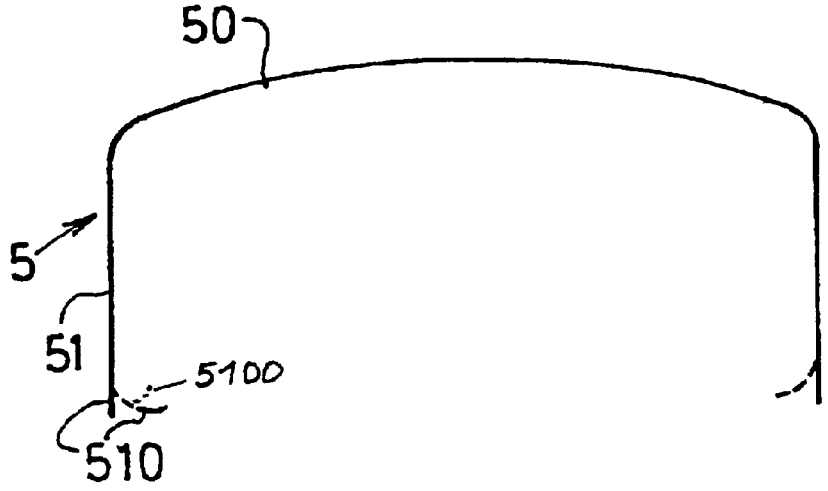
FIG.5a

COMPOSITE CLOSURE CAP

BACKGROUND OF THE INVENTION

This invention relates to the field of screw caps, typically for the closure of containers, bottles or flasks designed to be used for spirits, such as cognac, whisky, bourbon, etc . . . and typically for the closure of glassware containers with necks having a diameter greater than the standard diameter, usually 30.5 mm.

DESCRIPTION OF THE RELATED ART.

Composite screw caps are already well known. Thus the French application No 9706009 in the name of the applicant describes a metal screw cap with a threaded plastic insert, the insert being held within the metal cap using an adhesive layer inside the metal cap, said layer comprising said plastic in a divided state.

Furthermore the screw caps typically used in the specific area of the invention are normally threaded caps made from moulded bakelite.

The American patent U.S. Pat. No. 3,215,297 also describes a screw cap utilising a threaded plastic insert fitted inside a metallic envelope, the lower extremity of this envelope being rolled in order to enter the plastic insert and thus be protected from corrosion.

Furthermore, in other areas not related to this invention, the French invention FR 1362 085 is well known which describes a cap for perfume bottles. This stopper comprises a threaded plastic cap which provides a support for a metal disc and a cap, the whole unit being assembled using a crimped metal ring.

In this same field of cosmetics, there is the known international application WO99/06294, which describes a stopper for cosmetic products, in plastics material, where the skirt is covered with a crimped metal sheath.

Finally, in the field of infant baby foods, there is the known international application WO98/52833 which describes the PT (Press-on/Twist-off) caps which comprise an annular preformed moulded annular seal fitted to the metal cap by rolling of the lower edge of the metal cap.

Caps using current bakelite techniques are known to adhere to the glass threads, which can make opening very difficult.

Moreover, these bakelite caps project a very traditional image, such an image being sought in certain areas, but which more often than not is not desirable, since tastes change with time even for well known traditional brands.

Thus it is important to provide a manufacturer of spirits and alcohol a means of renewing the packaging of the bottled alcohol, spirits and liqueurs, principally by way of a new cap that fulfils the technical function of the existing caps, but also offers the possibilities of modernising the product in aspects other than technical, and where all too often such aspects dominate as the technical differences between products become blurred.

Finally, it is important that these caps rely on a small number of distinct parts from which they are assembled and/or rely on a small number of manufacturing phases.

SUMMARY OF THE INVENTION

The composite screw cap in accordance with the invention comprises an assembly of a) a plastic insert comprising a head fitted with a leakproof stopper sealing arrangement and a threaded skirt, and b) a metallic envelope in which :

1) the said metallic envelope covers all or part of the exterior surface of the head of the said insert and comprises at least a metallic skirt that covers the said skirt of the said insert,
2) the said metallic skirt comprises an edge that is crimped to the said insert, typically at the lower edge of the skirt of the said insert, in order to ensure the correct assembly of the said metallic envelope and the said insert, and is characterised by the said cap comprising a way of providing weight and/or volume to the part of the said capsule situated above the said arrangement used to provide the leakproof stopper.

This cap resolves the problems posed. In particular, the invention makes it possible to transform a screw cap into a top-of-the-range stopper, notably because of its looks and volume, and/or by the feel when the cap is handled, due typically to the weight, as will become apparent in the figures of the invention which serve to illustrate several embodiments of the invention, notably in the areas where weight and volume above the sealed screw cap have been added. Moreover this screw cap remains economical to manufacture.

BRIEF DESCRIPTION OF THE DRAWINGS

All the figures relate to the invention.

FIGS. 1, 2, 3, 4, 5, 5*a*, 6, 6*a*, 7, 8, 9, 10, 11 and 12 are cross sections along the vertical axis 10 of the cap 1.

In FIGS. 1, 2, 6, 7, 9 and 12, the cross sections are in respect of screw caps fitted to a threaded bottle neck 7, the cap 1 is represented in section, whereas the neck is represented in cross section on the right part of the figure and in perspective on the left part of the figure.

In FIG. 1, the way that volume is provided is by using a void 30 which forms a significant added height above the detachable seal 31.

FIG. 2 is similar to FIG. 1, and also comprises a supplementary object 6 inserted into the void 30, typically in order to weight the said cap.

FIGS. 3 to 3*a* refer to another type of plastic insert 2 in which the said void 30 has radial partitions 300, in order to maintain the detachable seal (not shown) in a strictly fixed position.

FIG. 3*a* is a view from below and FIG. 3*b* is a perspective side view from below.

In FIG. 3*a*, 6 voids 40 have been shown and these are designed to ensure the metallic envelope 5 and insert 2 are locked together during rotation, as shown in FIGS. 4 and 4*a*.

FIGS. 4 and 5 represent capsules analogous to those shown in FIGS. 1 and 2 respectively, but they differ in that the leakproof sealing arrangement is provided by a circular sealing lip 32.

FIG. 4*a* is a magnified view of the left inner end of the cap represented in FIG. 4, illustrating a cut-out 40 in the lower edge 41 of the insert 2 in which is crimped the end 5100 of the skirt 51 in order to lock together during rotation the metallic envelope 5 and the insert 2.

FIG. 5*a* shows the metallic envelope 5 prior to assembly. Shown at the lower end of the skirt 51 is the crimping edge 510, shown as straight lines of the metallic envelope prior to assembly, and as dotted lines once crimped to the insert, and thus folded inwards, the crimping edge 5100 also shown as dotted lines, representing the part of the edge that has been crimped into the cut-out 40 of the insert.

FIGS. 6 to 7 represent the case where the head 50 of the metallic envelope 5 provides an orifice 500, as shown in FIG. 6*a*, and a supplementary object 6, 6', which passes through this orifice, in order to increase the volume of the part of the cap located above the detachable seal 31 which provides the leak proof sealing arrangement.

In FIG. 6 the cap includes a supplementary object 6 which passes through the said orifice 500 and with its circular foot attached between the rim of the insert and the head 50 of the metallic envelope.

Figure 7:
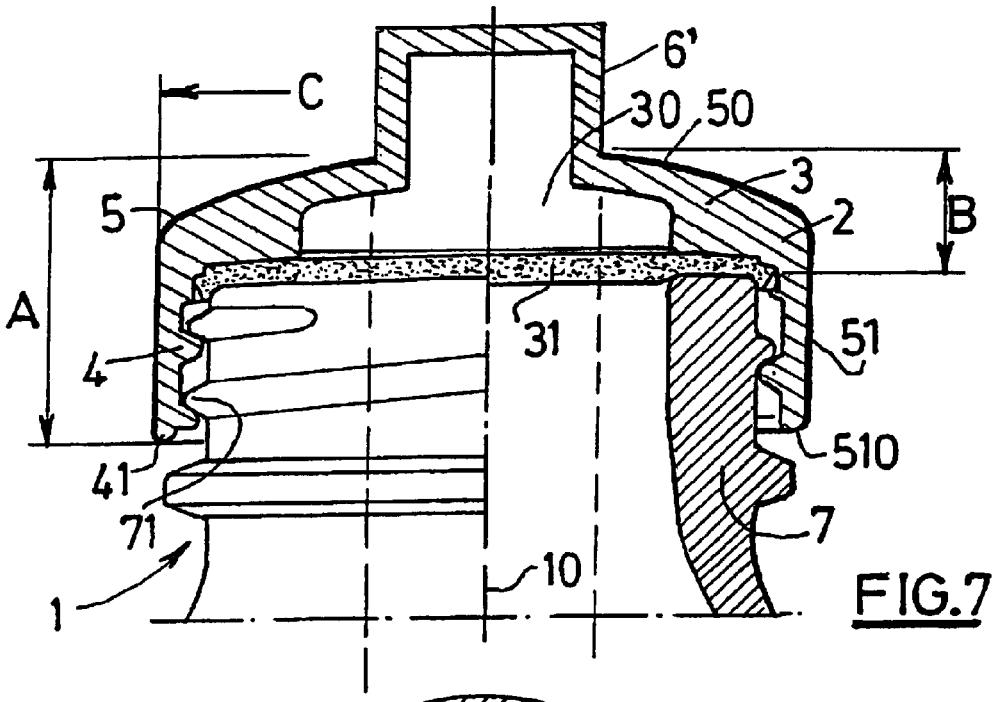

On the other hand, in FIG. 7, it is the plastic insert itself that passes through the said orifice in the shape of a protrusion to form the supplementary object 6'.

Figure 8:
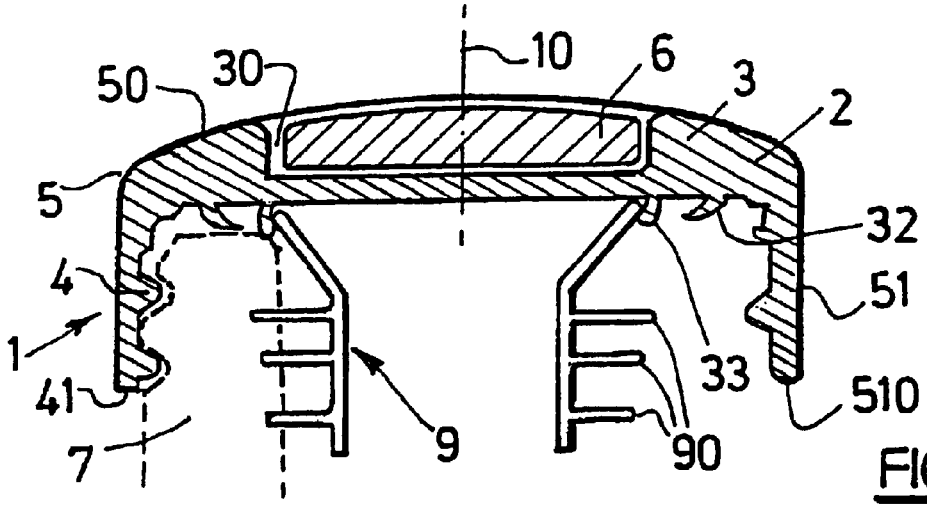

In FIG. 8, which is similar to FIG. 5, a cap equipped with retention lips 33 has been shown which allows a semi-permanent attachment between the cap 1 and a pourer 9 fitted with circular attachment ribs 90 to engage within the neck 7, which has been shown as dotted lines in the left half of the figure.

Figure 1:
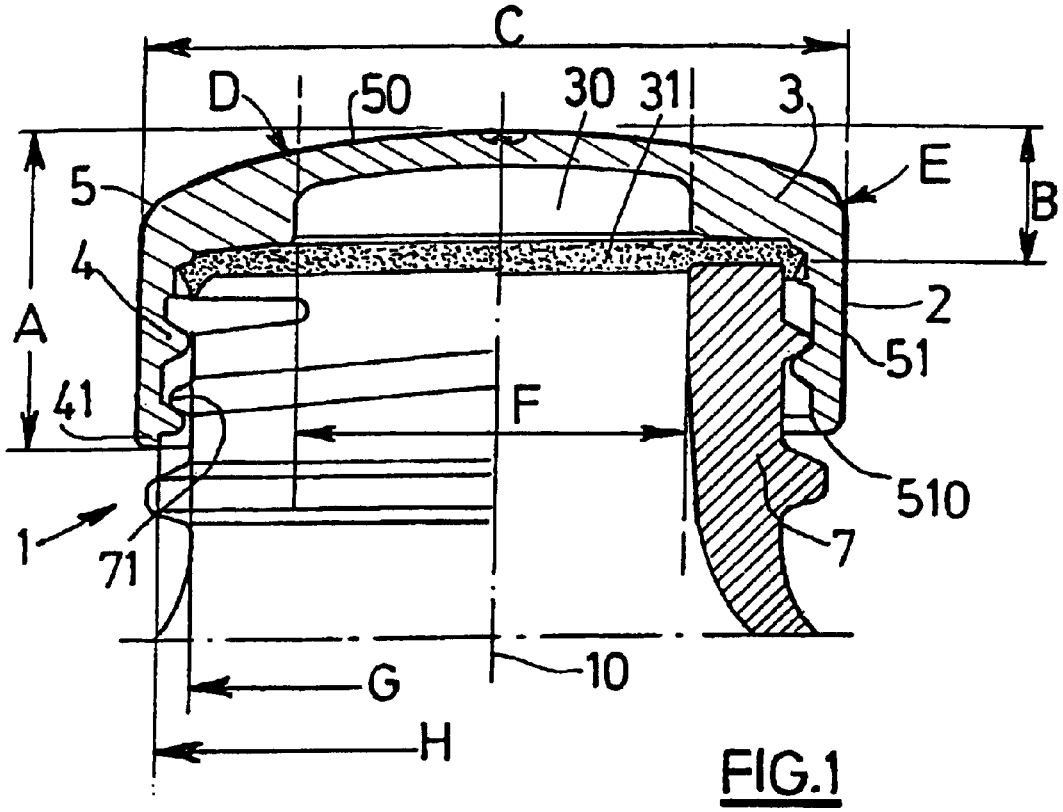
Figure 2:
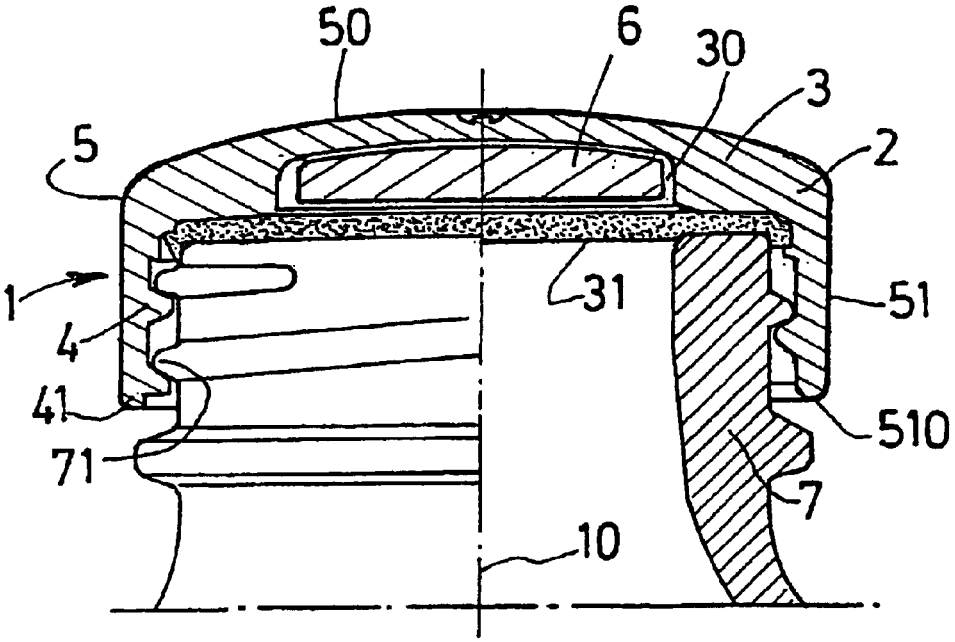
Figure 9:
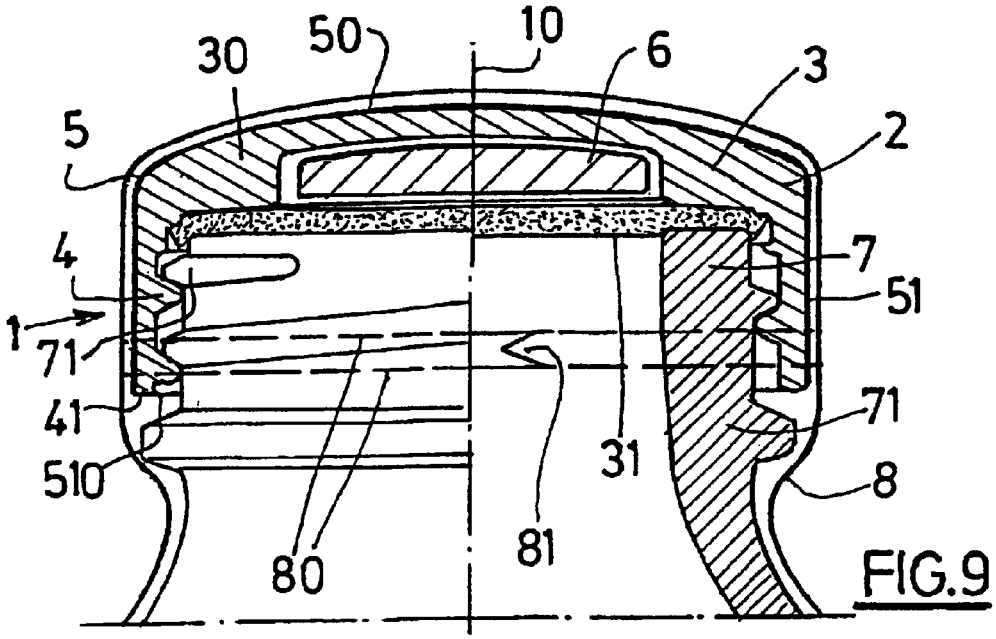

In FIG. 9, which is similar to FIG. 2, a screw cap 1 is shown fitted with an outer sealing cover 8 either crimped or heat shrunk in place beneath the lower surface of the thread 71 of the neck 7, and comprising two tear lines 80 which provide a tongue 81 for initial opening of the container.

Figure 10:
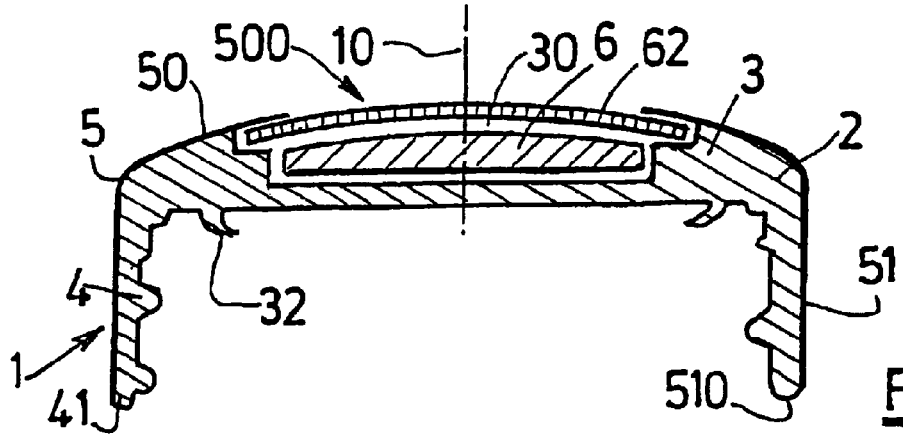

In FIG. 10, which is similar to FIG. 5, the orifice 500 of the head 50 of the metallic envelope is closed with a component made from a transparent material 62 with a supplementary object 6 within the void 30.

Figure 11:
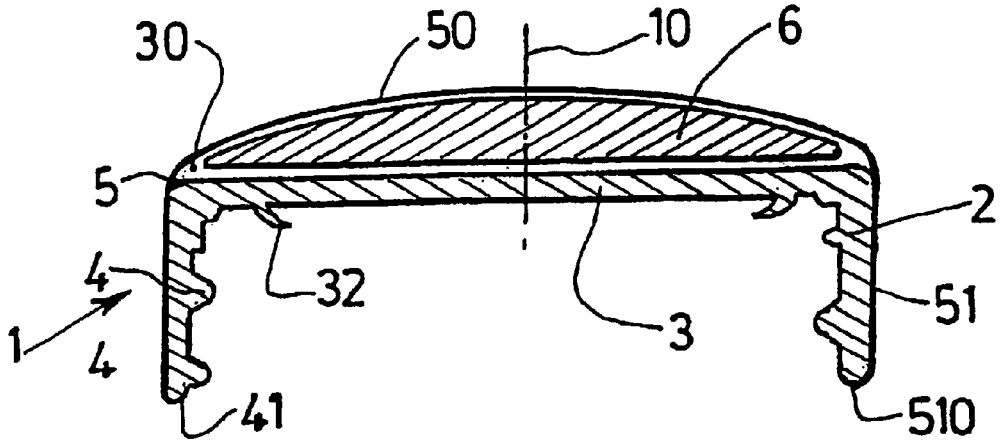

In FIG. 11, which is similar to FIG. 5, the void 30 extends over the full cross sectional area of the cap, and is contained with the space between the insert head 3 and the head 50 of the metallic envelope.

Figure 12:
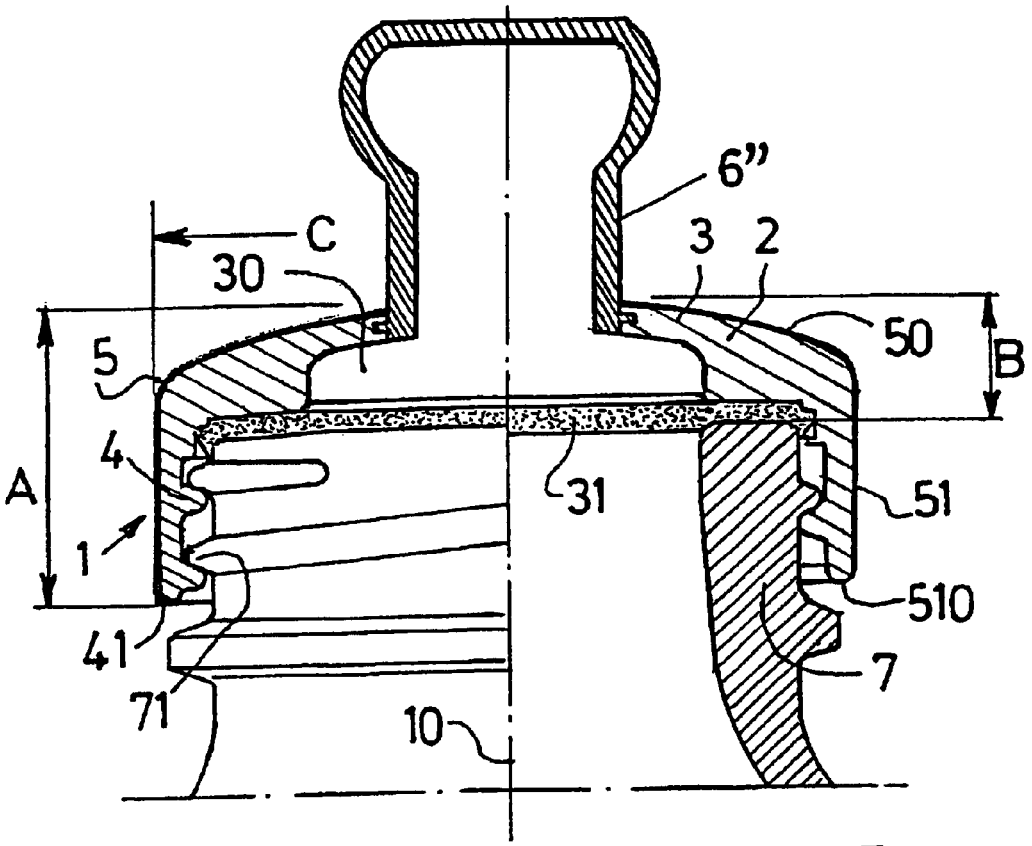

In FIG. 12, which is similar to FIG. 7, the supplementary object is a detachable item 6" which is clipped or clicked into the head 3 of the insert 2, and which as a result is able to present a much larger diameter than that of the orifice 500 itself—this item 6" may also be attached to the remainder of the cap with a screw thread or adhesive.

DETAILED DESCRIPTION OF THE INVENTION

In accordance with the invention, the said crimped edge 510 of the said metallic skirt 51 may cover all or a part of the lower edge 40 of the skirt 4 of the said insert 2.

As illustrated in all the figures relating to the caps 1, the crimped edge 510 in fact hides the insert 2 which cannot be seen by the consumer when opening and closing the cap 1. This enables the "technical" and "aesthetic" functions to be separated, the "technical" functions such as those involving sealing, screwing, general mechanical characteristics which are a function of the plastic insert, and the "aesthetic" functions which are a function of the visible surfaces, especially the metallic envelope.

The cap in accordance with the invention may include a void 30 formed in the said insert 2 or bounded by the said insert 2 with the said metallic envelope 5 and/or the said sealing arrangement 31, 32. This void 30 is located above the sealing arrangement 31, 32, the axis 10 of the neck being vertical and these sealing arrangements lying in a horizontal plane as shown in the figures.

In all the figures, except FIG. 11, the said void 30 corresponds to a void within the insert itself.

In all cases, the said void 30 is bounded by the head 3 of the insert and the head 50 of the metallic envelope and/or the sealing arrangement, typically the detachable seal 31.

This void mainly allows the required volume to be attributed to the upper part of the cap, without modifying the "technical" part of the cap, in particular where the sealing and the screw thread is involved.

The said arrangement which provides volume or weight may include a supplementary object 6 locked to the said cap 1, typically during assembly, and/or by exploiting the said void 30, as illustrated in FIGS. 2, 5, 6, 7, 8, 9, 10, and 11.

Figure 6:
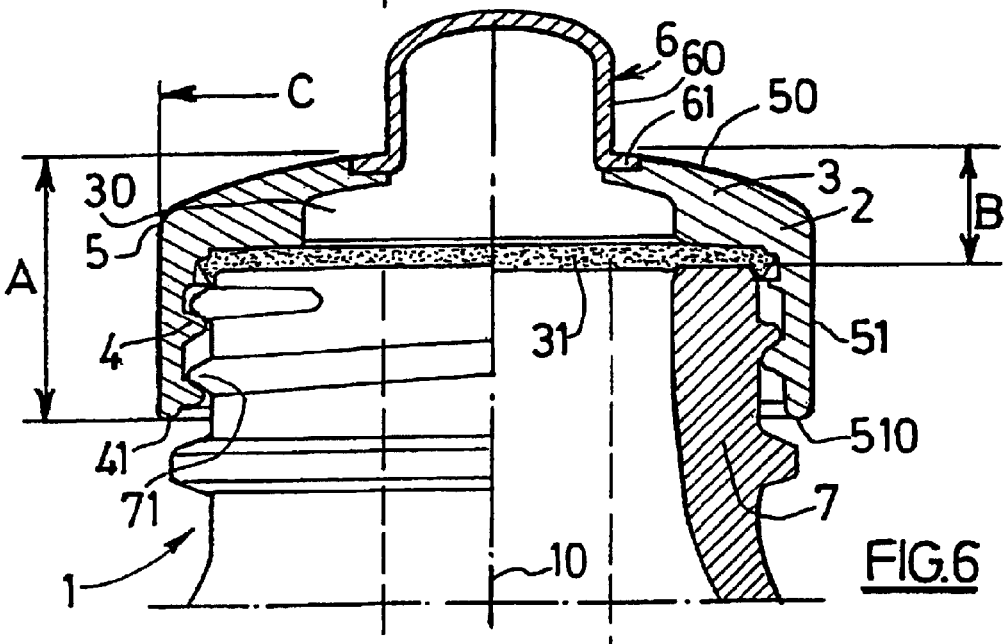
Figure 6A:
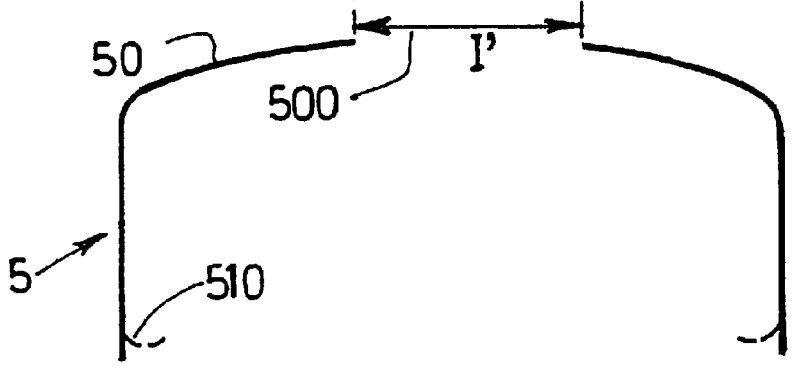

This supplementary object 6 may be a ballast weight with a density ideally greater than 4, typically made of iron, and used to increase the weight of the cap, and held within the said void 30, as shown in the previous figures except FIG. 6. But, any sort of material could be used such as a piece of mineral, stone or ceramic.

In accordance with the invention, the said supplementary object 6 may comprise a system of identification and/or detection, an item containing information, or a miniature measuring device held within the said void, possibly adding to the weight of the cap.

As an example amongst many, it is possible to embed a date marker, a temperature indicator, a hygrometer, with the corresponding transducer or miniaturised measuring instrument contained within the void 30, and in such a case, the void can be blanked with a transparent material 62, as shown in FIG. 10.

In accordance with a configuration of the invention the said metallic envelope may include a head 50 having an upper orifice 500, such that the said insert 2 or its head 3, and/or the said supplementary object 6 may emerge through the said orifice 500, as illustrated in FIGS. 6*a*, 7, 8 and 10.

As shown in FIG. 7, the said insert 2 or its head 3 may form an extension passing through the said orifice and thus comprising the supplementary object 6'.

As illustrated in FIG. 6, the said supplementary object 6 comprises a body 60 which passes through the said orifice 500 and a base flange 61 which is held inside the said void 30 or between the head of the insert 3 and the head of the metallic envelope 50.

This option considerably multiplies the possibilities for personalisation of the caps in accordance with the invention, because it is only necessary to alter the supplementary object, by changing its shape, the material from which it is made (metal, glass, steel, plastics material, etc. . . . ), without considering the style of the design or surface texture variations.

In accordance with a particular configuration shown at FIG. 10, the said orifice 500 may be blanked using a transparent material 62, in order to see inside the said void 30 or observe its contents which may possibly include the said supplementary object 6.

In accordance with the invention, the said metallic envelope 5 may be made from aluminium or tin plate, steel, or tin, but typically using 80 to 350 $\mu$m thick aluminium.

The said insert 2 may be a moulded thermoplastics material, such as polyolefin, polyester or polyamide.

Preferably, the insert 2 is made from a polyolefin having a yield strength under load at 90° C. that is sufficient to avoid the threads of the said insert from deforming when the said insert is raised to temperatures as high as 60° C. Among the polyolefins, a copolymer of polypropylene is preferable. It may also be advantageous to use highly transparent plastics material, such as liquid crystal polymers LCP, polycycloolefins COP, for example Zeonor 1600R (R).

Generally speaking, the said metallic envelope 5 can be decorated externally, as well as any item passing through the orifice 500 of the head 50 of the metallic envelope, and which, consequently becomes a visible and integral item of the cap, and thus a part of its image or general appearance, as is the case in FIGS. 6 and 7.

In accordance with the invention, the said leakproof sealing arrangement may be created using a detachable seal 31, as shown in FIGS. 1, 2, 6, 7 and 9 ; it may involve using a sealing lip 32 affixed to the internal surface of the head of the said insert, as shown in FIGS. 4, 5, 8, 10 and 11.

As shown in FIG. 8, a pouring item 9 possibly preventing the vessel from being refilled could be permanently fitted to the said cap 1, typically with a click-lock device, using a flexible lip 33 formed on the inner surface of the said head of the insert.

Figure 3B:
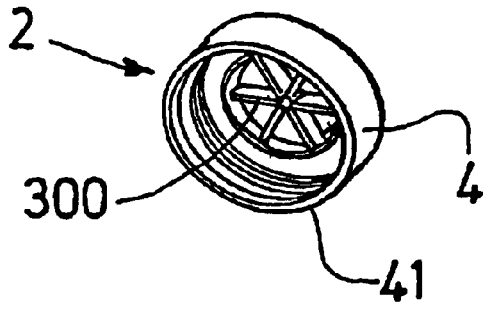
Figure 3:
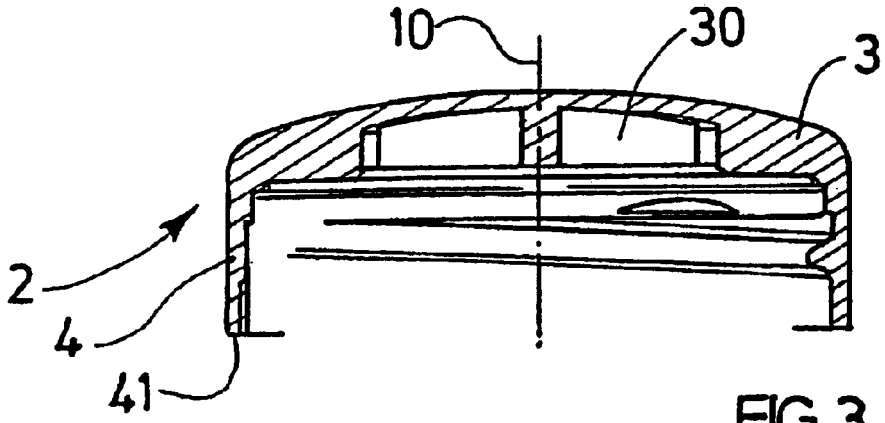
Figure 3A:
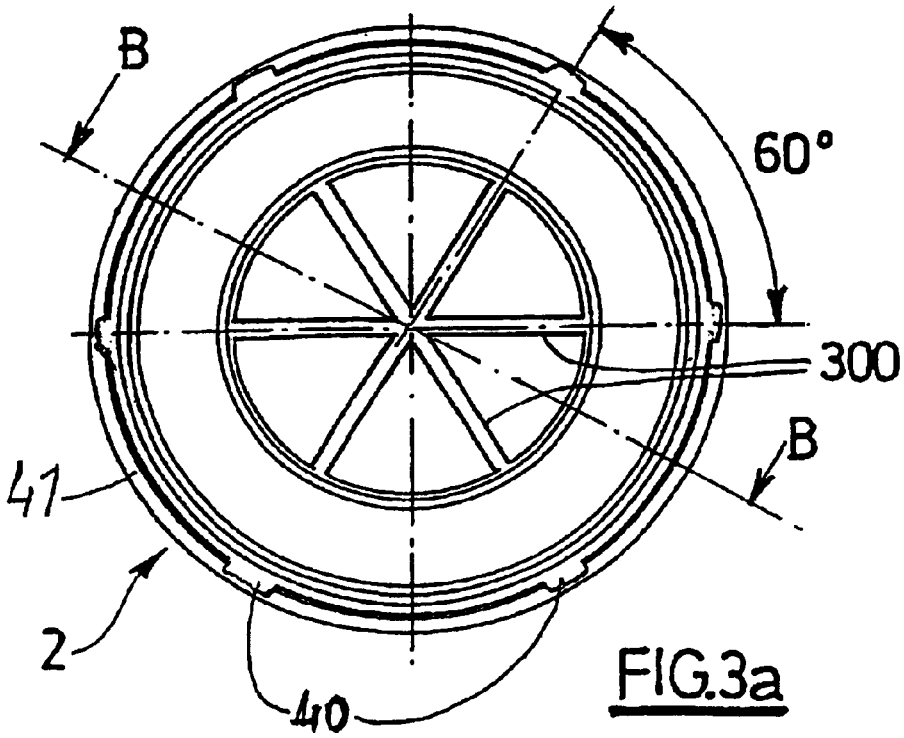

In accordance with a variant of the invention, shown in FIGS. 3 to 3*b*, the said void can be partitioned, usually using radial elements 300 or circular elements.

This partitioning may be useful especially in order to improve the mechanical strength of the detachable seal 31 by providing a rigid base for the seal, and thus improving its sealing performance.

The cap in accordance with the invention may comprise an outer sealing cover 8 which is used to guarantee the tamperproof integrity of the said cap 1 and provide an easy opening method 80, 81, as shown in FIG. 9. This outer sealing cover 8 could be a sealing capsule, typically of a heat shrink type, with a primary opening band 81 released using two tear lines 80.

It is of course also possible to add to a bottle or flask that has been closed using the cap in accordance with the invention any kind of outer sealing arrangement known, in order to provide the required tamperproof integrity.

As shown in FIGS. 4 and 4*a*, the lower edge 41 of the skirt 4 of the said insert 2 advantageously includes cut-outs 40, typically 6 in total spaced at 60° to each other, in which a portion 5100 of the edge 510 of the said metallic skirt 51 is crimped, in order to ensure both the metallic skirt 51 and the said skirt 4 of the said insert 2 rotate together. Thus without the use of adhesive between the insert 2 and the metallic skirt 5, both these items are locked together in order to rotate in unison.

Another object of the invention is a method for the manufacture of a cap 1 according to the invention wherein:

a) the said plastic insert 2 with threaded skirt 4, possibly a void, as well as the said metallic envelope 5 to match the insert and possibly the detachable seal 31 are supplied, b) the said supplementary object 6 or any other item used in the final assembly are supplied, c) the said plastic insert 2 and the said metallic envelope 5, after 'inclusion' of the supplementary object 6 or any other item used in the final assembly are assembled, and the lower edge 510 of the skirt 51 of the metallic envelope 5 is crimped to the lower edge 41 of the skirt 4 of the plastic insert 2, and possibly the detachable seal 31 is inserted.

Another object of the invention concerns using the cap according to the invention as a games feature.

In fact, on the one hand, the fact that there is a void means that within it may be inserted a standard games feature that may produce sound, or electromagnetic waves, or contain a smart chip, and furthermore be used for other means such as identification, and fraud detection, etc . . .

On the other hand, the caps according to the invention may, at least in certain instances, be used once their use as a container, bottle or flask stopper is fulfilled, as a games feature, and typically as a "punching bag" when weighted by a large enough mass in the form of the supplementary object.

EMBODIMENT EXAMPLES

Caps in accordance with the attached figures have been made. For all these caps, the same external dimensions have been kept for the metallic envelope 5. These dimensions are the following (see FIGS. 1 and 6*a*) :

height A: 15.75 mm
height B (above the seal): 6.8 mm
diameter C: 35.3 mm
radius of curvature D: 50 mm
radius of curvature E: 5 mm
internal diameter F of the void (or neck): 20 mm
internal diameter at crest of the thread G: 30 mm
internal diameter at root of the thread H: 32.8 mm
diameter of orifice 500 I: 12 mm The chosen materials are :

for the metallic envelope 5: 100 $\mu$m thick strip aluminium chosen from the series 3000 alloy range using the Aluminium Association nomenclature, either varnished, printed or brushed, for the plastic insert 2: a copolymer of PP, as the supplementary object 6: a piece of iron weighing 5/10/15/20 g as in FIGS. 1, 2, 5, 8, 9, 10 and 11 has been used, in the case of FIG. 6, the supplementary object 6 is made from PE, in the case of the caps with seals, a commercial standard seal in the shape of a washer with an effective diameter of H (32.8 mm) has been used.

Manufacture of the Caps:

Initially the three types of component used are made separately:

the insert 2 has been made using injection moulding, the metallic envelope 5 has been made by stamping, the supplementary objects 6, 6' have been supplied where they are made from iron, or moulded in the case of FIGS. 6 and 7.

They are then assembled. The method of assembly of the different components may vary depending upon the exact configuration of each cap, but those skilled in the art will identify the appropriate method after examining the examples shown in the following figures.

In general, it is usual practice to insert the said supplementary objects 6 between the metallic envelope 5 and the insert 2, prior to crimping the edge 510 of the metallic skirt to the lower edge 41 of the insert. However, FIGS. 2 (or 9) illustrates a different case : the supplementary object 6 can be introduced between the insert 2 and the detachable seal 31, after crimping of the metallic envelope 5 and the insert 2.

BENEFITS OF THE INVENTION

As shown by the embodiment examples and the figures, the invention opens numerous possibilities in response to the problems in need of solution.

It provides ways of personalising caps by making it possible to manufacture an infinite number of different caps without the need to modify the technical components from which the cap is made, i.e. the threads, the insert and its interface with the glassware attachment rings of the bottles or flasks, and all areas affecting the sealing.

Moreover, this invention opens wider horizons for the traditional caps, providing them with new functions, beyond the usual technical requirements, notably in the field of games, identification or fraud detection.

Finally, the cap according to the invention is particularly inexpensive, especially when considering that a single crimping of the edge 510, 5100 of the metallic envelope 5 to the plastic insert 2 is all that is required to lock them together, including in rotation, and to lock in place the supplementary object 6 whenever included.

| LIST OF REFERENCES | |
|---|---|
| SCREW CAP | 1 |
| VERTICAL AXIS | 10 |
| PLASTIC INSERT | 2 |
| INSERT HEAD | 3 |
| VOID | 30 |
| RADIAL PARTITIONS | 300 |
| DETACHABLE SEAL | 31 |
| SEALING LIPS | 32 |
| ATTACHMENT LIPS | 33 |
| THREADED SKIRT OF INSERT | 4 |
| CUT-OUT | 40 |
| LOWER EDGE | 41 |
| METALLIC ENVELOPE | 5 |
| HEAD OF ENVELOPE | 50 |
| ORIFICE | 500 |
| METALLIC SKIRT | 51 |
| CRIMPING EDGE | 510 |
| CRIMPING EDGE in the cut-out 40 | 5100 |
| SUPPLEMENTARY OBJECT | 6 |
| INSERT AND SUPPLEMENTARY OBJECT | 6' |
| CLIPPED OBJECT | 6" |
| BODY | 60 |
| BASE FLANGE | 61 |
| TRANSPARENT BLANK | 62 |
| THREADED NECK | 7 |
| NECK THREADS | 70 |
| NECK THREAD LOWER SURFACE | 71 |
| OUTER SEALING COVER | 8 |
| TEAR LINES | 80 |
| OPENING TONGUE | 81 |
| POURER | 9 |
| FIXING RIBS | 90 |

What is claimed is:

1. Composite screw cap comprising an assembly a) of a plastic insert comprising a head fitted with a leakproof sealing arrangement and a threaded skirt, and b) a metallic envelope in which:

1) the metallic envelope comprises a head which completely covers the head of the insert and at least a metallic skirt which covers the skirt of the insert, 2) the metallic skirt comprises an edge that is crimped to the insert at the lower edge of the skirt of the insert, in order to ensure the assembly of the metallic envelope and the insert, the cap comprising means for adding weight and/or volume to a part of the cap situated above the said sealing arrangement.

2. cap according to claim 1 in which the crimping edge of the metallic skirt covers all or part of the lower edge of the skirt of the insert.

3. Cap according to claim 1 comprising a void formed in the insert or bounded by the insert.

4. Cap according to claim 3 in which the void is partitioned using radial or circular elements.

5. Cap according to claim 1 in which the means for providing weight or volume comprises a supplementary object made integral with the cap.

6. Cap according to the claim 5 in which the supplementary object is a ballast weight with a density greater than 4, constructed and arranged to increase the weight of the cap, and held within the said void.

7. Cap according to the claim 5 in which the supplementary object comprises means for identification and/or detection, or an item carrying information or a measuring instrument, held within the said void.

8. Cap according to claim 1 in which the metallic envelope is made from aluminum, tin plate, steel or tin.

9. Cap according to claim 1 in which the insert is a thermoplastics material able to be molded.

10. Cap according to claim 9 in which the insert is made from a polyolefin having a yield strength under load at 90° C. that is sufficient to prevent the threads of the said insert from deforming when the insert is raised to a temperature as high as60° C.

11. Cap according to claim 10 in which the polyolefin is a polypropylene copolymer.

12. Cap according to claim 1 in which the said metallic envelope is decorated externally.

13. Cap according to claim 1 in which the leakproof sealing arrangement comprises a detachable seal.

14. Cap according to claim 1 in which the leakproof sealing arrangement comprises a sealing lip fitted to the inner surface of the head of the insert.

15. Cap according to claim 1 comprising an outer sealing cover which is used to guarantee the tamper proof integrity of the cap and provide an easy means of opening.

16. Cap according to claim 15 in which the outer sealing cover is also a sealing capsule, with a primary opening band released using two tear lines.

17. Cap according to claim 1 in which the lower edge of the skirt of the insert comprises cutouts spaced at 60° to each other, in which an edge part of the edge of the metallic skirt is crimped, in order to ensure both the metallic skirt and the skirt of the insert rotate together.

18. Method of manufacture of a cap according to claim 1 comprising the steps of:

a) supplying the plastic insert with threaded skirt as well as the metallic envelope to match the insert, b) supplying the means for adding weight and/or volume, c) assembling the plastic insert and the metallic envelope, with inclusion of the means for adding, crimping the lower edge of the skirt of the metallic envelope to the lower edge of the skirt of the plastic insert.

* * * * *